US007712337B2

(12) United States Patent
Glueck

(10) Patent No.: US 7,712,337 B2
(45) Date of Patent: May 11, 2010

(54) MEASURING DEVICE COMPRISING AN OPTICAL SENSORY ARRAY, AND METHOD USING SAID MEASURING DEVICE

(75) Inventor: Stefan Glueck, Niederwerrn (DE)

(73) Assignee: Schaeffler KG, Herzogenaurach (DE)

( * ) Notice: Subject to any disclaimer, the term of this patent is extended or adjusted under 35 U.S.C. 154(b) by 515 days.

(21) Appl. No.: 11/574,993

(22) PCT Filed: Aug. 12, 2005

(86) PCT No.: PCT/DE2005/001426

§ 371 (c)(1),
(2), (4) Date: Mar. 9, 2007

(87) PCT Pub. No.: WO2006/026949

PCT Pub. Date: Mar. 16, 2006

(65) Prior Publication Data

US 2008/0092600 A1 Apr. 24, 2008

(30) Foreign Application Priority Data

Sep. 10, 2004 (DE) ..... 10 2004 043 752

(51) Int. Cl.
*D06F 33/00* (2006.01)
*D06F 37/20* (2006.01)

(52) U.S. Cl. ..... 68/12.06; 68/12.27; 68/23.1

(58) Field of Classification Search ..... 68/12.06, 68/12.27, 23.1, 23.3, 24
See application file for complete search history.

(56) References Cited

U.S. PATENT DOCUMENTS

| | | | | |
|---|---|---|---|---|
| 4,677,291 | A * | 6/1987 | Ellingson | 250/231.1 |
| 5,713,221 | A * | 2/1998 | Myers et al. | 68/12.06 |
| 5,893,280 | A * | 4/1999 | Honda et al. | 68/12.06 |
| 6,023,854 | A * | 2/2000 | Tsunomoto et al. | 34/531 |
| 6,418,758 | B1 * | 7/2002 | Ikeda et al. | 68/12.06 |
| 6,615,619 | B2 * | 9/2003 | Kakuda et al. | 68/24 |
| 2002/0020196 | A1 * | 2/2002 | Kakuda et al. | 68/12.06 |
| 2003/0140427 | A1 * | 7/2003 | Yamamoto et al. | 8/159 |

FOREIGN PATENT DOCUMENTS

| | | |
|---|---|---|
| DE | 29 15 815 A | 11/1980 |
| DE | 198 12 683 A | 9/1998 |
| DE | 198 23 903 | 12/1999 |
| SU | 1 719 846 | 3/1992 |
| WO | 2005/090904 E | 9/2005 |

* cited by examiner

*Primary Examiner*—Joseph L Perrin
(74) *Attorney, Agent, or Firm*—Lucas & Mercanti, LLP

(57) ABSTRACT

The invention relates to a measuring device, comprising an optical sensory array for determining changes in the position of a drum which is mounted in a washing machine at least so as to be pivotable about a swiveling axis. The sensory array is provided with at least one light sensor, at least one modifiable light passage, and at least one light source. The light sensor is directed to portions of light which are emitted by the light source, are dependent upon changes in the light passage, and impinge the light sensor.

11 Claims, 5 Drawing Sheets

Figure 1:
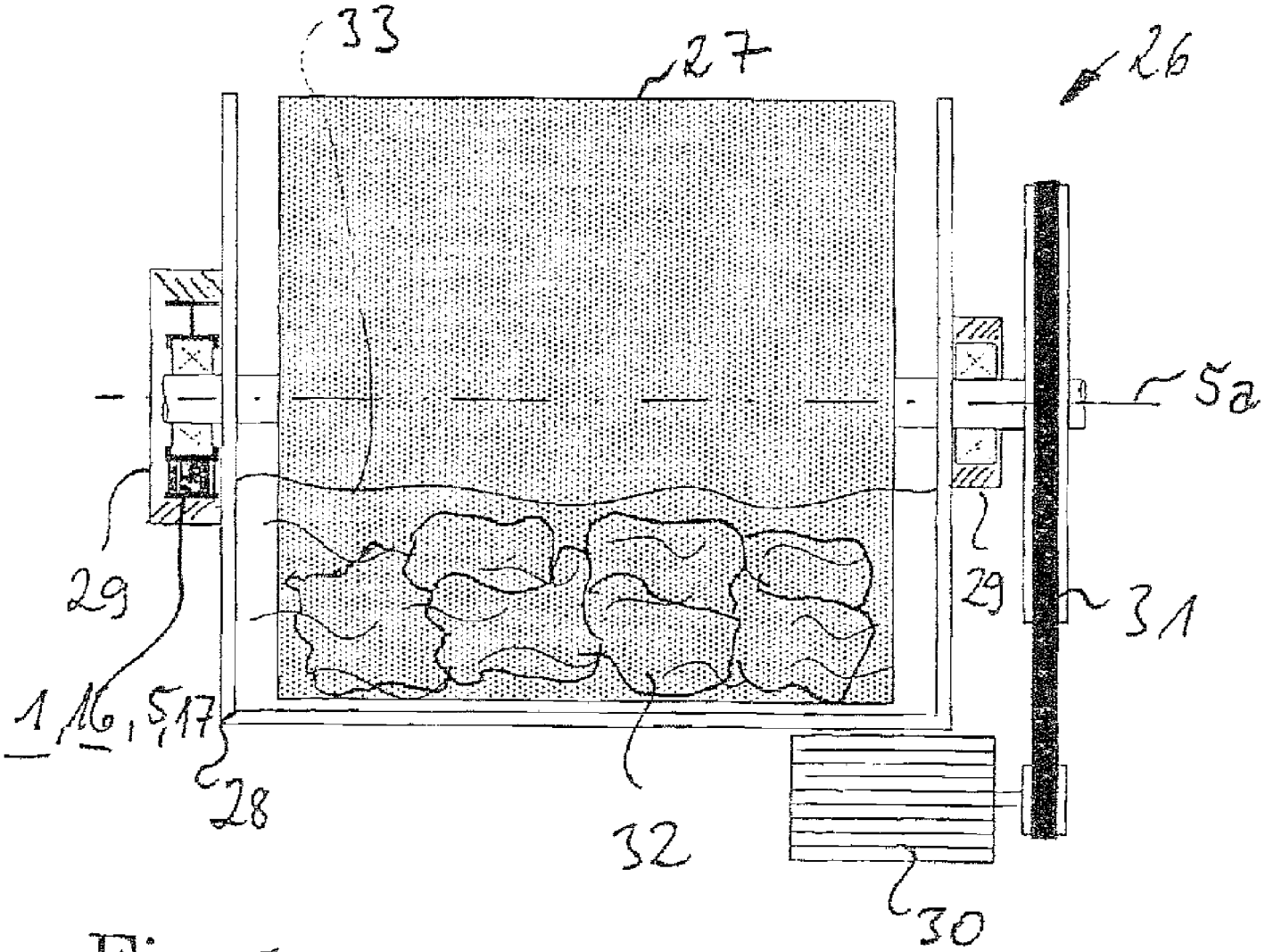

MEASURING DEVICE COMPRISING AN OPTICAL SENSORY ARRAY, AND METHOD USING SAID MEASURING DEVICE

FIELD OF THE INVENTION

The invention relates to a measuring device comprising an optical sensory array for determining positional changes of a drum which is mounted in a washing machine such that it can be pivoted at least about a rotational axis, and to a method for measuring by way of the measuring device.

BACKGROUND OF THE INVENTION

The centroid or the centroid axis of a washing machine drum is displaced from the rotational axis (out of the rotational center in an ideal initial position) by nonuniform distribution of the laundry and is therefore spaced apart from the rotational axis. The rotation of the centroid with the spacing from the rotational center causes centrifugal forces on the drum which have to be supported by the bearing arrangement on the washing machine. The greater the centroid axis deviates from the initial position, the greater what is known as the unbalance. This unbalance leads to undesired movements of the washing drum which is usually suspended elastically. The drum can swing out so far from the ideal rotational axis that contact occurs between the washing machine and the drum. Moreover, the rotational axis of the drum cannot coincide with the main axis of inertia of the drum as a result of the nonuniform distribution of the laundry in the drum, that is to say the rotational axis is tilted at the centroid. Dynamic unbalances of this type cause bending moments on the bearing journals during operation of the washing machine, by way of which bearing journals the drum is mounted rotatably in the washing machine, and result in undesired oscillations or in unnecessary bearing stresses.

The high bearing forces and oscillations which result from the unbalances can lead to premature wear of the bearing arrangements.

The movement and flooding of the is not sufficient in an overfilled washing drum. The cleaning action is insufficient. On the other hand, a washing drum which is not filled sufficiently leads to unnecessary energy and water consumption. In modern washing machines, the filling ratio, that is to say the amount of dry laundry in relation to the drum volume, is a characteristic variable for calculating washing processes which are optimized in terms of consumption and results. The amount is determined in the washing machine by means of a device using the dry weight. Subsequently, the operating criteria are fixed automatically as a function of the filling ratio which is calculated therefrom.

Positional changes are therefore to be understood as all changes of the position of the centroid or the centroid axis of the drum, and therefore also at least of one bearing for the drum, with respect to the initial position of the rotational axis in the case of nonstressed and nonrotating drums. Unbalances as a result of nonuniform material distribution on the drum itself are therefore also considered.

DE 31 17 106 A1 describes a measuring device of the generic type, by way of which the oscillation amplitudes which result from harmful oscillations and therefore the positional change of the drum with respect to the rotational axis are measured. The optical sensory array of the measuring device is arranged between the drum and one tub of the washing machine and outputs a signal after a limiting value is exceeded of the closeness of the drum and the tub. The signal causes a change and regulation of the rotational speed of the drum, with the target of reducing the unbalances. The measuring device is not suitable for detecting positional changes of the drum by means of the weight of the drum or for continuous measuring operations.

SUMMARY OF THE INVENTION

It is the object of the invention to provide a measuring device, by way of which the positional changes as a result of the weight of the laundry and also the positional changes which result from unbalances of the drum can be detected using measuring technology. The device should be simple to manufacture and robust, and also be suitable in some circumstances for retrofitting existing washing machine models.

This object is achieved according to the subject matter of the characterizing part of claim 1 in that the sensory array has at least one light sensor, at least one variable light passage and at least one light source. The light sensor is directed onto parts of the light of the light source which emanate from the light source, are dependent on changes in the light passage and strike the light sensor. The oscillation amplitudes which result from harmful oscillations and therefore the positional change of the drum with respect to the rotational axis are measured by way of the measuring device. Depending on the measuring state, the signals which emanate from the sensor result in a constant measured value (constant proportion) for the static loading from weight and in a changing signal (sine or rectangular curve) for dynamic loadings from the unbalances.

The measuring device has at least one light source. All technical light sources are conceivable, such as light-emitting diodes, laser sources, infrared light sources, lamps, etc. The type of light, as a rule a bundle of rays, can be selected alternatively as a function of the selected light source.

At least one of the light passages is made in elastically yielding material between the rotational axis of the drum and the washing machine, it being possible for the material to be deformed elastically at least at the light passage as a result of the positional changes of the drum. The material, for example the material of a supporting ring for a bearing, is seated either between a journal of the drum and the inner ring of the bearing or preferably radially between the bearing for the drum and the housing of the washing machine. In the first case, the stresses from the drum are introduced first into the supporting ring and then relayed via the elastic material to the bearing. In the last-mentioned case, one refinement of the invention, the stresses are transmitted from the drum first to the bearing and then preferably to a supporting ring. In this case, the supporting ring is mounted, for example, on a bearing flange or on a bearing support which is fixed to the housing of the washing machine.

The measuring device has at least one or a plurality of light passages which is/are arranged sensibly in the vicinity of the bearing arrangement of the drum, on one or on both bearings of the drum. Thus, one refinement of the invention provides for the light passage to be arranged radially between the rotational axis and the preferably rotary bearing, optionally sliding or roller bearing for the drum on the washing machine side, the drum being mounted in the washing machine by way of the bearing such that it can be pivoted at least about the rotational axis. The outer ring of the bearing is surrounded by the supporting ring which is formed at least partially from the elastically yielding material and in which at least the light passages are formed. The supporting ring can be manufactured as desired from plastic or other suitable materials or from combinations of the former, and can be provided with the light passages. One of the light passages preferably follows the bearing in the direction of gravity, at least for the determination of the weight of the laundry.

The supporting ring optionally has at least one web which extends radially from the bearing, the web having at least one of the light passages. Here, at least the web is formed from the elastically yielding material.

The light passage is, for example, a gap, a slot or a hole, or a passage for light of another design. Part of the light of the light source is kept back at the edge of the light passage. The other part of the light passes through the passage and strikes the light sensor or a reflector in an unobstructed manner. The passage cross section of the light passage is variable by deformations of the elastically deformable material at the element edges of the light passage which delimit the light passage. It is also conceivable that the edges are displaced with respect to an initial position without being deformed and therefore change the light passage. The stresses of the bearing which were mentioned in the introduction as a result of the weight of the laundry and/or unbalances lead to these elastic deformations of the material, at least in that region, in which the light passage is formed. As a consequence of this, the edges which lie opposite one another and delimit the light passage come closer to each other or move further away from one another. The light passage/gap therefore acts as an aperture. The free opening of the aperture changes in an analogous manner to the magnitude of the stresses which are exerted on the bearing. The portion of light which strikes the light sensor is variable as a function of the element edges which are movable toward one another and away from one another.

Moreover, stresses are all of the action and reaction forces which act on the bearing and result from the mounting of a component which can be moved rotationally or linearly.

The sensor or sensors is/are depending on the light source all suitable technical transducers of light, such as light-sensitive resistors, photodiodes, phototransistors or the like.

In a further alternative refinement of the invention, the sensory array/measuring device at least comprising the light sensors and the light source/sources, connection elements and further electronic components is optionally preassembled as one structural unit, for example, on a mounting plate. The structural unit is plugged into the supporting ring during assembly of the measuring device.

The light source and at least one of the light sensors lie opposite one another in a manner which is separated from one another by the supporting ring, in such a way that at least one part of the light is directed onto the light sensor through the light passage. As an alternative to this, the light source and at least one of the light sensors lie opposite a reflector in such a way that at least part of the light can be reflected onto the light sensor by the reflector, either through the light passage again or directly.

The changing brightness of the light, ageing of the light source or of the light sensor, fluctuations in the current supply or the influence of the environment such as temperature and air humidity, etc., possibly influence and falsify the measured results. For this reason, the measuring device has, as a rule, a further comparative sensor in addition to the light sensor and/or is provided with a comparison light source in addition to the light source, with the result that a comparison of the actual and the setpoint values can be performed continuously.

The measuring device is secured against destruction as a result of overloading. In a case of this type, for example, the elastic regions with the light passages are connected in series or in parallel with rigid parts of the support. The rigid supports absorb the overloading in the sense of an overload safeguard. It is also conceivable that an overload safeguard of this type is provided by the size of the light passage, that is to say by the height of the gap itself. If a defined load is exceeded, the element edges which lie opposite one another at the gap then come into contact with one another, for example, with the result that the gap width of the light passage is equal to zero at least in regions.

The device is of simple and robust configuration and can be manufactured inexpensively. The sensor array comprising the light source and the sensor and all necessary further electrical and electronic components are either arranged separately from the supporting ring or are optionally integrated into the latter.

Special manufacturing preparation of the bearings for use with a device according to the invention is not necessary. The use of all desired radial or axial bearings, or combinations of these, is conceivable. The essential components of the measuring device can be integrated into an adapter ring/supporting ring. The dimensions of the supporting ring/adapter ring can be adapted without much expenditure to surrounding constructions which are already present. On account of the spatial distance of the light passage from the stressed bearing, the stresses of the bearing point can be measured without the influence of the elastic deformations at bearing rings on the measured values. In the event of corresponding proximity to the bearing and sufficient flexibility of the support in the region of the light passages, however, the influences of deformations of the bearing rings can also be detected by way of the measuring device.

The measuring device makes the detection of bearing loads possible in ranges from small to high loads. It is therefore possible to determine unbalances which are characterized by high forces as a rule, and to determine the relatively low dry weight of the laundry by way of one or more of the measuring devices in a washing machine. To this end, for example, sensors with sensitivities and therefore measuring ranges which differ from one another with respect to the light parts which are to be measured are used in a washing machine.

In one case, the sensor or sensors is/are adapted to ranges of low loads in order to determine the laundry weight. Here, signals, which are independent of time, rotational speeds and rotational direction about the rotational axis, of positional changes of the drum as a result of static stresses are evaluated. The measuring range is defined, for example, by overall weights of the laundry in the drum from 0 to 10 kg. At the same time, it is possible to evaluate positional changes from unbalances by signals which change in a time-dependent manner, the signals emanating from that light sensor, by way of which the weight of the laundry is also detected. In this case, on account of the magnitude differences of the active forces from weight with respect to the forces from unbalances, the presence of the unbalances and their position are determined, but, as a rule, not their absolute value (for example, at the level of the active centrifugal force).

In the other case, one or more of the sensors is/are calibrated to the parts of the light at the maximal permissible stresses. To this end, signals of the light sensor which change in a time-dependent manner are evaluated, which light sensor detects at least those parts of the light which pass through the light gap at the maximal permissible positional changes of the drum. The maximal permissible limits are defined, for example, by the maximum permissible loading from centrifugal forces on the drum, for example by a limit of 4000 N.

Furthermore, the measuring ranges of the measuring device are dependent on the design of the light passage and on the rigidity of the elastic material. If the light passage is of rigid design, the magnitude of the unbalances can be determined as an absolute value. If the light passage is of yielding soft design, it is suitable, in particular, for determining the weight of the laundry. In the last case, unbalances can also be detected by way of the same sensory array, but without measurement of the absolute magnitude of said unbalances.

DETAILED DESCRIPTION OF THE DRAWINGS

Exemplary embodiments of the invention will be explained in greater detail in the following text using FIGS. 1 to 5*b*.

FIG. 1 shows a schematic illustration of a longitudinal section along the rotational axis 5*a* of a washing machine 26.

Figure 2B:
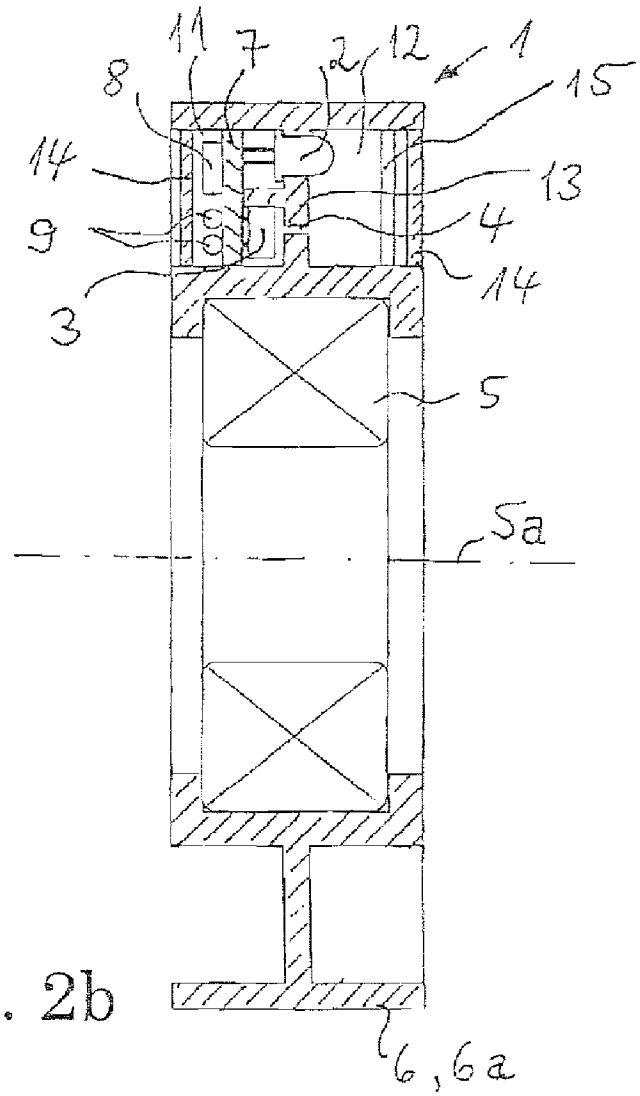
Figure 2A:
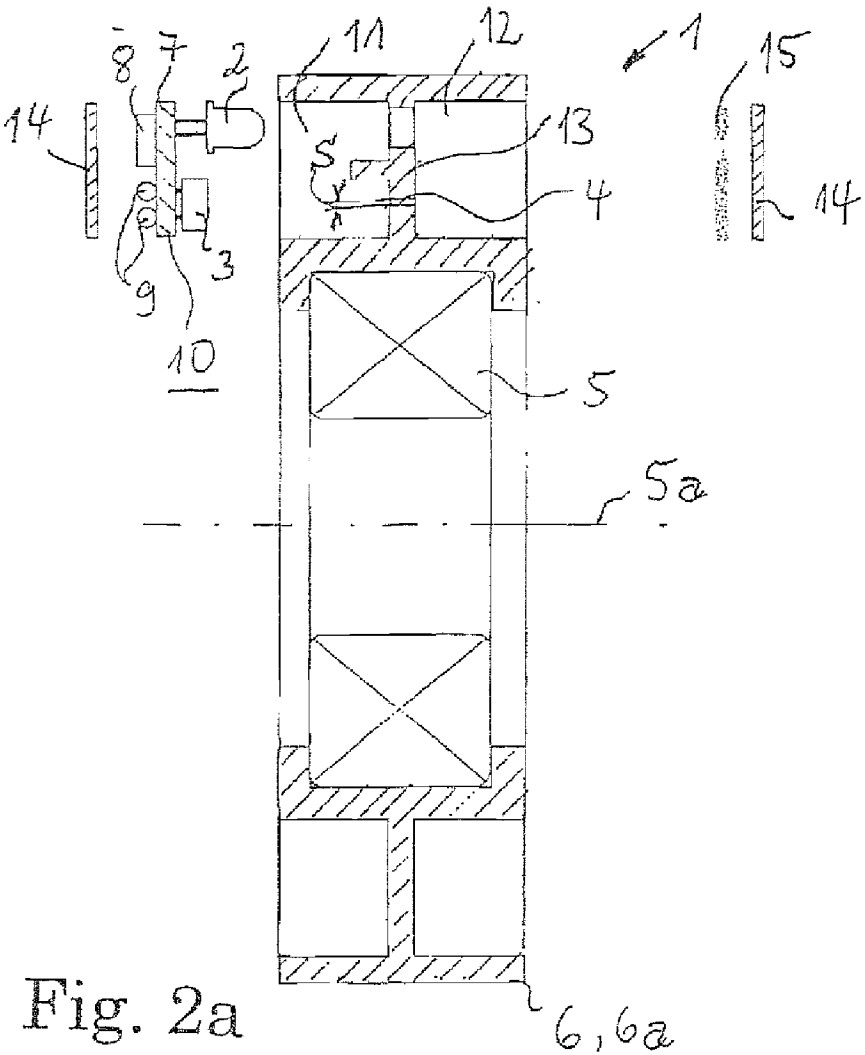

FIGS. 2*a* and 2*b* show, in simplified form, a measuring device 1 for detecting stresses of a bearing 5 for a washing machine, in a longitudinal section along the rotational axis 5*a* (axis of rotation 5*a*) of the bearing arrangement 5.

Figure 3:
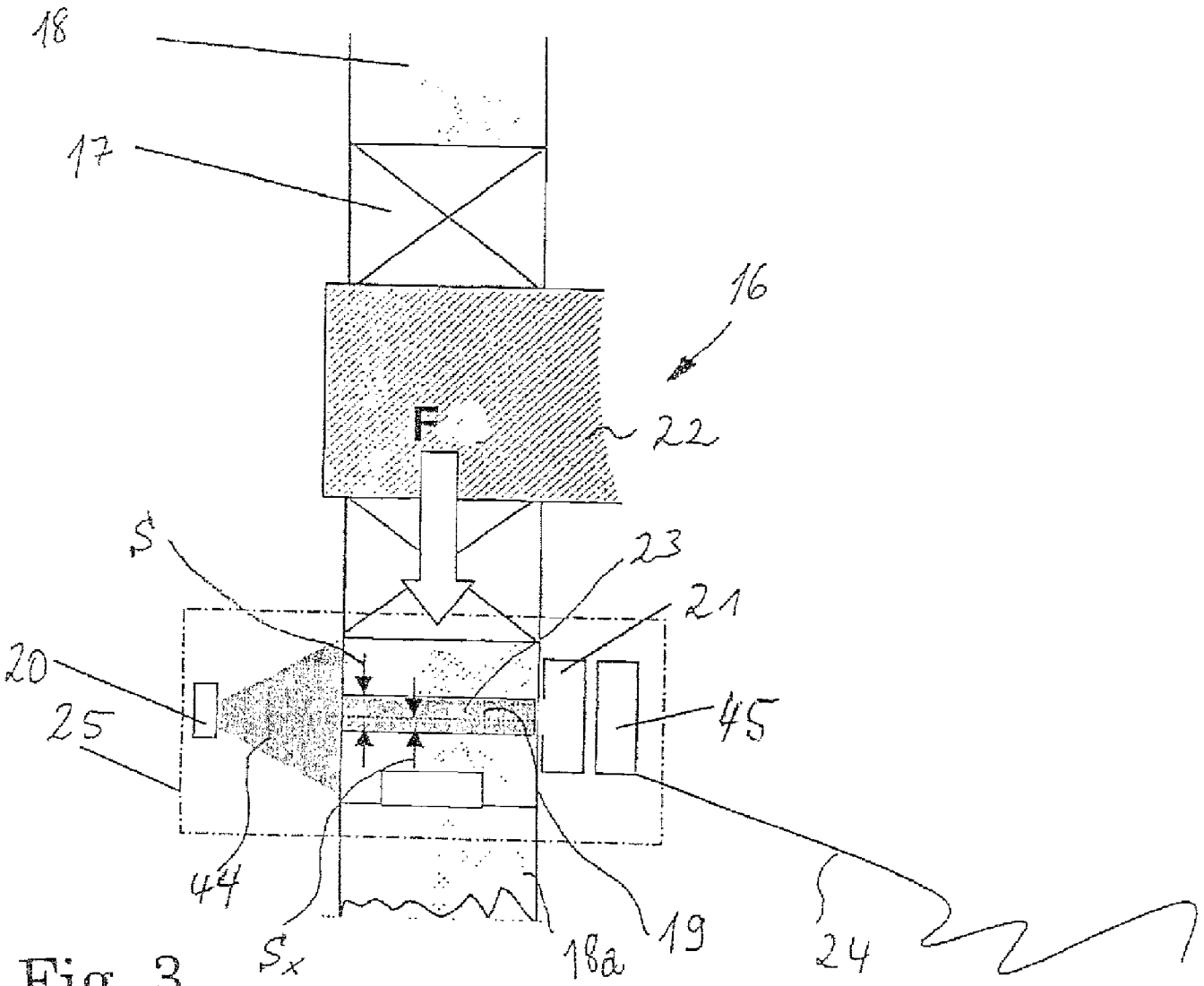

FIG. 3 shows, in schematic form, a further exemplary embodiment of a measuring device 16 for detecting stresses of the bearing 17.

Figure 4:
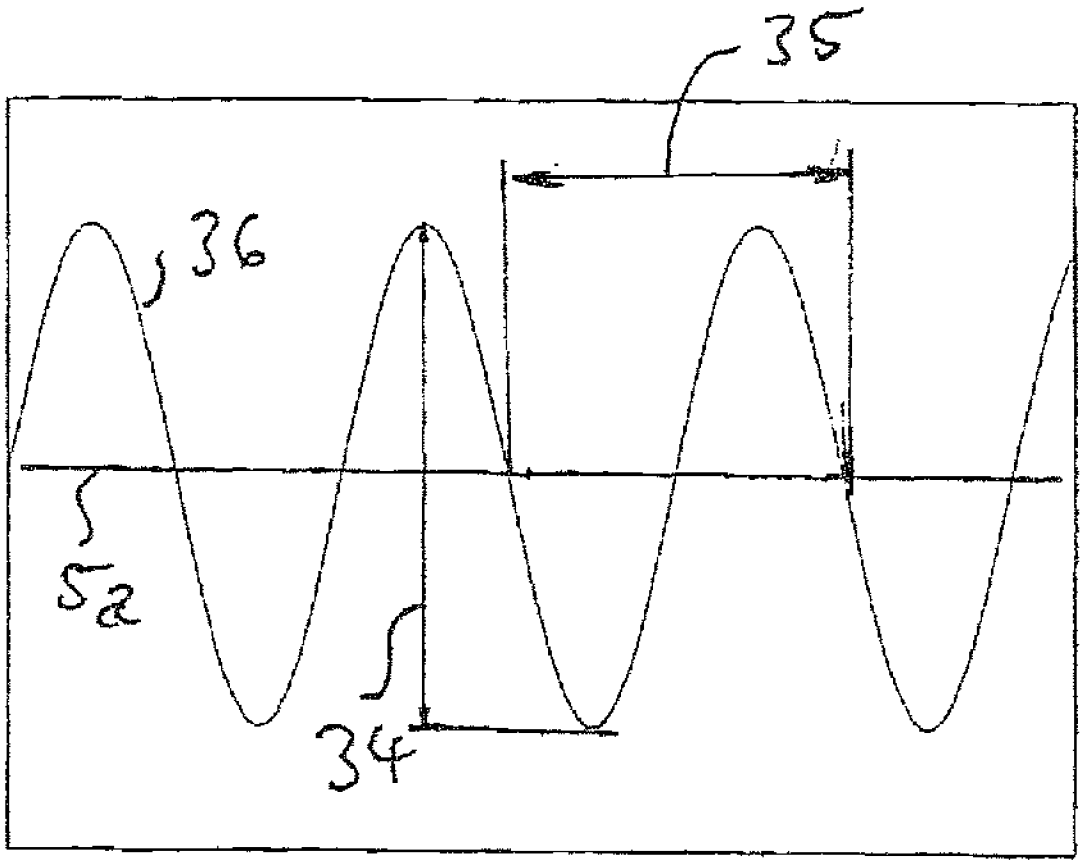
Figure 5B:
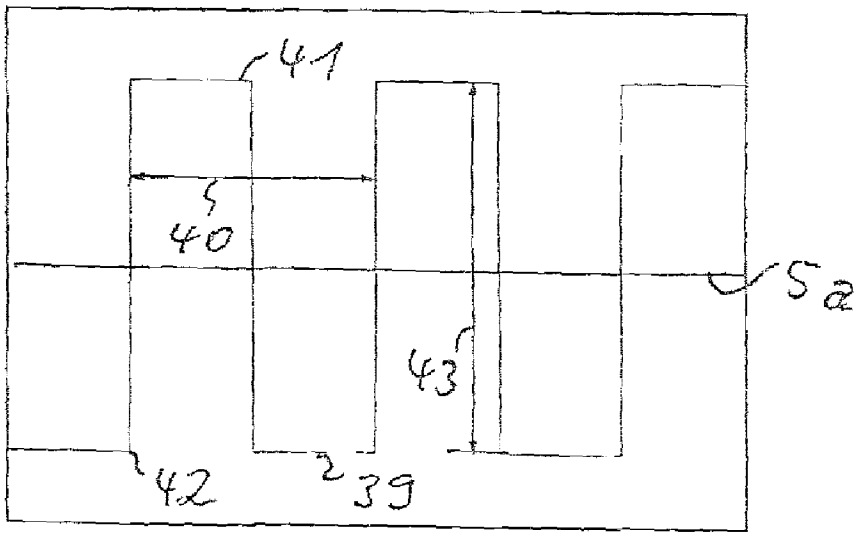

FIGS. 4 to 5*b* show, in diagram form, sensor signals 36 to 39 from measurements with one exemplary embodiment of the invention.

The washing machine 26 has a drum 27, a tub 28 and, in outlines, a housing 29. The bearing arrangement of the drum 27 has at least one embodiment of a measuring device 1 with a bearing 5 or a measuring device 16 with a bearing 17. The drum 27 is mounted pivotably and rotatably in the housing 29 and is driven by means of an electric motor 30 via a belt drive 31 or the like. Laundry 32 in the drum 27 is covered with water 33 in the tub 28.

FIG. 2*a* shows the measuring device 1 before final assembly and FIG. 2*b* shows it as a finally assembled module. In this case, the bearing 5 is a radial bearing, for example a roller or sliding bearing. The measuring device 1 has at least one light source 2, at least one light sensor 3 and at least one light passage 4. The light passage 4 is formed, in a manner which is spatially separated from the bearing arrangement 5, in an at least partially elastically yielding support 6 which is coupled to the bearing arrangement 5 and is in the form of a supporting ring 6*a*. The radial bearing is held in the supporting ring 6*a*. The supporting ring 6*a* is a composite part with, for example, an outer ring of the bearing 5. The outer ring (not shown in further detail) is encapsulated by injection molding with the plastic of the supporting ring 6*a* in order to manufacture the composite. It is also conceivable that the supporting ring is pressed onto the outer ring.

The light source 2 and the light sensor 3 are mounted on a common mounting plate 7, together with further electronic components 8 and conductors or connection elements 9, to form a unit 10. The supporting ring 6*a* has a chamber 11 and a further chamber 12. The chambers 11 and 12 are separated from one another by a radial web 13 of the supporting ring. The web is designed to be at least elastically yielding enough in the radial direction that the radial gap width S of the light passage 4 is variable as a function of the stresses on the bearing arrangement 5. The light passage 4 is formed in the web 13. During the assembly of the measuring device 1, the unit 10 is plugged into the chamber 11 and fastened in the supporting ring 6*a*. The chamber 11 is closed at the end by way of a cover 14 which can be provided with plated-through holes for connecting conductors or alternatively closes the chamber 11 in a watertight manner.

The light source 2 protrudes into the chamber 12 through the web 13. A reflector 15 which is directed onto the light passage 4 lies axially opposite the web 13 in the chamber 12. The chamber 12 is closed also at the end by way of a cover 14, to which the reflector 15 can optionally be fastened or applied by coating. The light sensor 3 detects the part of the light of the light source 2 which is reflected by the reflector 15 onto the light passage 4 and passes through the light passage 4.

The bearing 17 according to FIG. 3 is surrounded by a stationary support 18 in the form of a supporting ring 18*a*. A journal 22 of the drum 27 is mounted rotatably by way of the bearing 17. The supporting ring 18*a* is manufactured, for example, from plastic. At least one light passage 19 which is assigned in each case at least one light source 20 and one light sensor 21 is formed in the supporting ring 18*a* in a manner which is separated spatially from the bearing 17.

The stresses of the bearing 17 can be detected using the changes in the gap width S to $S_x$ and vice versa of the light passage 19. The gap width S is dependent on the stresses F and elastic shape changes which result therefrom on the supporting ring 18*a* in the region of the light passage. One part of the light 23 of the light source 20 which is directed onto the light passage 19 outside the support 18 passes through the light passage 19. That part of the light 44 which is dependent on the size of the gap width S to $S_x$ and therefore on the stresses, for example on the force F, is detected by a light sensor 21 on the side which lies opposite the light source 20, is scanned by an evaluation unit 45 and is forwarded by conductors 24. The sensor system is encapsulated by means of a housing 25 which is shown with a dashed line.

Characteristic values for the evaluation of the unbalance are, for example, the oscillations which the bearing is exposed to. The possible sensor signals 36 which result from the measurements by way of the devices 1 and 16 are represented as an amplitude 34 of the oscillation path in an evaluation unit, as shown in the example according to FIG. 4. The bearing center point is deflected away from the rotational axis 5*a* in opposite directions per revolution of the drum 27. A bearing oscillation is produced with the amplitude 34 and with the frequency 35 (periodic duration). In this case, the deflection (amplitude) can be used for determining the positional change of the drum 27 or the deflection of the bearing center point from the standard position. The deflection therefore at the same time describes the travel of the centroid of the drum 27 over time.

In the example according to FIG. 4, the light passage is so rigid and the measuring range of the light sensor 3 and/or 21 is configured in such a way that the unbalance does not lead to the saturation of the sensor signal 36. In this case, the level of the centrifugal force from the unbalance can therefore also be concluded from the deflection (amplitude). FIG. 4 shows only the profile for an unbalance mass by way of the sensor signal 36, in order to simplify the illustration. In practice, however, unbalances from a plurality of different masses are superimposed as a rule.

Figure 5A:
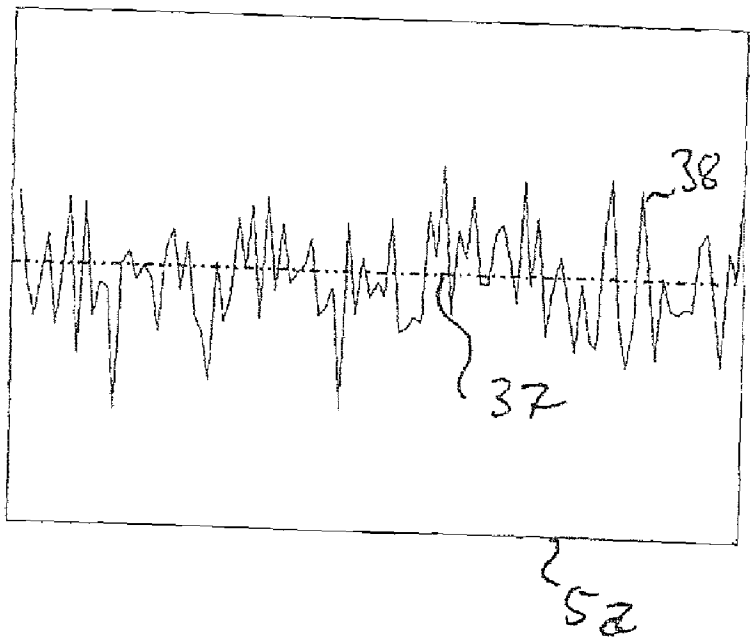

The diagram according to FIGS. 5*a* and 5*b* shows the signals of a light sensor 3, 21, the measuring range of which is adapted to determination of the laundry weight and therefore to ranges of low loads. The light passage is accordingly designed to be very soft and to already yield at low loads. The measuring range of the light sensor 3 or 21 is adapted accordingly.

FIG. 5*a* is an illustration of the signals from measuring results with respect to the weight of the laundry, with sensor signals 37 (constant proportions) which are independent of time, rotational speeds and rotational direction about the rotational axis from positional changes of the drum 27 in static stresses at a standstill of the drum 27. The sensor signals 37 are superimposed by sensor signals 38 which are caused by disruptive influences on the measurements, but not by the oscillations from the unbalances which were described in the introduction.

At the same time, it is possible to evaluate positional changes from unbalances as a result of signals according to FIG. 5*b* which change in a time-dependent manner, by way of the light sensor 3 or 21, the signals of which are shown in FIG. 5*a*. In this case, on account of the different magnitudes of the acting forces from weight with respect to the forces from unbalances, only the pure presence of the unbalances and their position are detected, but not the absolute value of the magnitude of the active centrifugal force. The sensor signal 39 is an approximate square wave signal which moves to and fro with the rotational frequency 40 of the drum from the lower limit 41 of the measuring range 43 of the light sensor 3 and/or 21 to the upper limit 42 of this measuring range 43.

LIST OF DESIGNATIONS

1 Measuring device
2 Light source
3 Light sensor
4 Light passage
5 Bearing
5*a* Rotational axis
6 Support
6*a* Supporting ring
7 Mounting plate
8 Component
9 Connection element
10 Unit
11 Chamber
12 Chamber
13 Web
14 Cover
15 Reflector
16 Measuring device
17 Bearing
18 Support
18*a* Supporting ring
19 Light passage
20 Light source
21 Light sensor
22 Journal
23 Light
24 Conductor
25 Housing
26 Washing machine
27 Drum
28 Tub
29 Housing
30 Electric motor
31 Belt drive
32 Laundry
33 Water
34 Amplitude
35 Frequency
36 Sensor signal
37 Sensor signal
38 Sensor signal
39 Sensor signal
40 Rotational frequency
41 Lower limit
42 Upper limit
43 Measuring range
44 Light
45 Evaluation unit

The invention claimed is:

1. A measuring device for determining positional changes of a washing machine drum that is pivotable about a rotational axis, comprising:

an optical sensory array having at least one light sensor, at least one variable light passage and at least one light source, the light passage being formed in an elastically yielding material between the rotational axis of the drum and the washing machine, the light sensor being arranged to detect light from the light source, and the light striking the light sensor being dependent on changes in the light passage, which is deformable elastically as a result of positional changes of the drum.

2. The measuring device as claimed in claim 1 wherein the light passage is arranged radially between a bearing and the washing machine, the bearing being provided for at least pivotable mounting of the drum in the washing machine.

3. The measuring device as claimed in claim 2, wherein the measuring device has the bearing, the bearing being a rotary bearing, and in that the bearing is surrounded by a supporting ring, the supporting ring being formed at least partially from the elastically yielding material and at least the light passage being formed here in the supporting ring.

4. The measuring device as claimed in claim 3, wherein the measuring device has a unit which can be plugged into the supporting ring and comprises at least the light source and the light sensor.

5. The measuring device as claimed in claim 4, wherein the measuring device has a mounting plate, at least the light source, the light sensor and connecting and connection elements being arranged on the mounting plate.

6. The measuring device as claimed in claim 3, wherein the supporting ring is made from plastic.

7. The measuring device as claimed in claim 3, wherein the supporting ring has at least one web which extends radially from the bearing, the web having at least one of the light passages.

8. The measuring device as claimed in claim 7, wherein at least the web is formed from the elastically yielding material.

9. The measuring device as claimed in claim 3, wherein the light source and at least one of the light sensors lie opposite one another in a manner which is separated from one another by the supporting ring, in such a way that at least one part of the light is directed onto the light sensor through the light passage.

10. The measuring device as claimed in claim 3, wherein the light source and at least one of the light sensors lie opposite a reflector in such a way that at least part of the light can be reflected onto the light sensor by the reflector.

11. The measuring device as claimed in claim 1, wherein the light passage is delimited by element edges which are movable toward one another and away from one another, and the light which strikes the light sensor varies by means of the element edges which are moveable toward one another and away from one another as a function of stresses.

* * * * *